United States Patent [19]

Dubost

[11] Patent Number: 4,812,178

[45] Date of Patent: Mar. 14, 1989

[54] METHOD OF HEAT TREATMENT OF AL-BASED ALLOYS CONTAINING LI AND THE PRODUCT OBTAINED BY THE METHOD

[76] Inventor: Bruno Dubost, 3, rue Casimir Brenier, 38120 Saint Egreve, France

[21] Appl. No.: 938,510

[22] Filed: Dec. 5, 1986

[51] Int. Cl.[4] ..... C22F 1/04

[52] U.S. Cl. ..... 148/12.7 A; 148/159; 148/415; 148/416; 148/417

[58] Field of Search ..... 148/12.7 A, 159, 415–418

[56] References Cited

FOREIGN PATENT DOCUMENTS 158571 10/1985 European Pat. Off. .

*Primary Examiner*—R. Dean

*Attorney, Agent, or Firm*—Dennison, Meserole, Pollack & Scheiner

[57] ABSTRACT

The invention concerns a method for final heat treatment ageing of Al alloys optionally containing Li and at least one other major element selected from the group Cu, Mg and Zn, as well as possible minor elements such as Zr, Mn, Cr, Ni, Hf, Ti and Be, in addition to inevitable impurities such as Fe and Si. The treatment involves a principal ageing operation which takes place at a time and temperature in an area defined by a parallelogram on a temperature log-time diagram, whose corners have the following coordinates: A 270° C.-3 min; B 270° C.-48 min; C 225° C.-9 hrs 30 min; D 225° C.-35 min. The heat treatment makes it possible to produce a satisfactory array of mechanical characteristics such as mechanical strength, ductility, or toughness and resistance to corrosion, which are higher than those achieved by means of conventional treatments of type T6 or by under-ageing operations.

26 Claims, 3 Drawing Sheets

METHOD OF HEAT TREATMENT OF AL-BASED ALLOYS CONTAINING LI AND THE PRODUCT OBTAINED BY THE METHOD

The invention concerns a method of final heat treatment artificial aging) of Al alloys essentially containing lithium and at least one other major element belonging to the group Cu, Mg and Zn, as well as minor elements such as Zr, Mn, Cr, Ni, Hf, Ti and Be, and in addition inevitable impurities such as Fe or Si, and the product obtained thereby.

The problem that the present invention solves is that of achieving, for the above-identified alloys, improved mechanical characteristics in the transverse direction (yield strength, tensile strength and elongation), impact strength, toughness and resistance to corrosion (intergranular and stress corrosion), as well as enhanced isotropy in respect of mechanical properties, in comparison with those of the same alloys when conventionally treated (aging to maximum hardening or under-aging, by means of a specific aging treatment, in spite of the fruitless attempts referred to hereinafter.

Indeed, in spite of their attractive characteristics as regards low density, high modulus of elasticity and good mechanical strength, Al alloys containing Li generally have either poor tolerance in respect of damage (low levels of ductility and toughness) or poor characteristics in respect of corrosion (intergranular or stress corrosion), in comparison with conventional Al alloys (series 2000 or 7000 using the Aluminium Association designation), having substantially equivalent mechanical strength. In addition, anisotropy and heterogeneity of the mechanical properties on non-recrystallised products is a recognised drawback of Al-Li alloys, with regard to use thereof.

The above-mentioned low level of ductility was reported in particular by E. A. STARKE et al (Journal of Metals, August 1981, pages 24 to 32) which sets forth a certain number of solutions for overcoming that problem such as:

- use of materials of a high state of purity, which are practically free from Na, P, S, $H_2$;
- use of rapid solidification, powder metallurgy and thermomechanical treatments in order to produce products with fine grains and/or structures which are non-recrystallised, with fine precipitation.

However those methods are complicated, long and relatively burdensome.

Metallurgists have recognised that under-aging of Al alloys with precipitation hardening containing Li results in the best compromise in respect of mechanical strength and ductility or toughness, at the expense of a poor level of resistance to intergranular corrosion as well as to stress corrosion in the transverse direction and a high degree of anisotropy in respect of the properties thereof. Over-aging results in a reduction in mechanical strength by coalescence of the metastable phase $\delta'(Al_3Li)$ in the matrix and also a reduction in the degrees of elongation and toughness by an increase in the size of the precipitation free zones of metastable phase $\delta'(Al_3Li)$, at the joints between grains. See I. G. PALMER et al, Al-Li Alloys II, Conf. Proceeding Met. Soc. AIME Montenay, 1983, 12th to 16th April, edited by A. STARKE Jr and T. H. SANDERS, page 105.

The latter phenomenon is also encountered in over-aging operations on Al-Li alloys containing Cu and/or Mg. They then have precipitation of phase $\delta'$ in the matrix which is always accompanied by co-precipitation of phases such as $T'_1$ and $T_1$ ($Al_2CuLi$) in the form of small plates, $T'_2$ or $T_2$ ($Al_6CuLi_3$) in the form of small rods, the phase S' or S ($Al_2CuMg$) in the form of needles or strips and $Al_2LiMg$.

However, in contrast to conventional alloys (series 2000 and 7000), such over-aging operations do not result in a high level of resistance to stress corrosion.

The final heat treatments used hitherto in regard to all known Al-based industrial or experimental alloys containing Li therefore involve single-stage aging operations at about 170° to 190° C. of type T6 (to produce the maximum of mechanical strength) or under-aging operations (in order to improve the tensile strength elongation or toughness compromise).

The heat treatment of Al-Li (Cu-Mg-Zn) alloys, according to the invention, which makes it possible to overcome all those disadvantages, comprises at least one solution treatment followed by a quenching operation, possibly plastic deformation of between 0.5 and 5%, ageing and finally at least one aging operation which we shall identify as the principal aging operation. The latter is carried out in the temperature range of between 215° and 270° C. for a period of between 3 minutes and 16 hours; the preferred range is between 220° and 260° C. for periods of time of between 5 minutes and 12 hours, the highest temperatures being generally associated with the shortest periods of time.

More precisely, the principal aging operation is to be carried out in a temperature-time range in the form of a parallelogram and the corners of which, on a temperature (°C.)-log time graph, are of the following coordinates:

A 270° C.-3 min
B 270° C.-48 min
C 215° C.-16 h
D 215° C.-1 h and preferably
E 260° C-5 min
F 260° C.-1 h 20
G 220° C.-12 h
H 220° C.-45 min The temperature of the principal aging operation, when the latter is isothermal, depends on the effective chemical composition of the alloy and is preferably between To−10° C. and To+25° C. with:

$$To(\text{in } ^\circ C.) = 65 + 80(\%Li) + 5(\%Mg) + 1.5(\%Zn),$$

the percentages being by weight, preferably with $1.7 \leqq \%Li \leqq 2.6$–$0.2\% \leqq Cu \leqq 3.4\%$-$Mg \leqq 7.0$ and $\%Zn \leqq 3\%$.

It should be noted that To is independent of the copper content of the alloy under consideration.

However the period of time must be sufficient to dissolve virtually the whole of the spherical phases $\delta' Al_3Li$ which were formed previously (for example in the cooling operation after quenching, in the ageing operation and/or in the temperature rise phase in the principal aging operation), except generally for the coarse phases $\delta'$ surrounding the dispersed particles of the globular $Al_3Zr$ phases (as demonstrated by GAYLE and VANDER SANDE-Scripta Metall. Vol. 18, 1984, pages 473–478) or again very occasional coarse particles of phase $\delta'$ (>25 nm) which are not dissolved at the temperature of the principal aging operation.

From the structural point of view, after the aging operation and outside of the non-dissolved particles, the structure comprises a fine dense precipitation of spherical phases δ' whose maximum size is smaller than 10 nm (and preferably smaller than 5 nm), which is formed in the cooling operation after the principal aging operation.

The globular phases δ' are then accompanied by at least one of the conventional hardening phases: S' or S-$Al_2CuMg$, $T'_1$ or $T_1$-$Al_2CuLi$, $Al_2MgLi$, $T'_2$ or $T_2$-$Al_6CuLi_3$, depending on the chemical composition of the alloy, the latter moreover being in the form of needles, plates, strips or rods in the matrix.

Excessive temperatures or times in the principal aging operation result in a loss in mechanical strength associated with a fall in ductility, toughness or impact strength. On the other hand, insufficient temperatures or times give rise to poor resistance to intergranular or stress corrosion, and a less good level of isotropy.

The principal aging operation may be preceded by a natural ageing operation or a pre-aging operation at a temperature of lower than 200° C. and for a period of time at most equivalent to that corresponding to the state T6 of the alloy in question, which makes it possible to increase the characteristics in respect of mechanical strength and resistance to corrosion, without substantial loss of ductility, in particular for Cu-charged alloys.

The duration of the pre-annealing operation (t') is limited upwardly in a temperature (°C.)-log time (in hours) diagram by the straight line of the following equation: $\theta = -60 \log t'_M + 260$.

The pre-aging operation is preferably included in the range of temperatures of from 120° to 180° C. for a minimum period of time $t'_m$ corresponding to the following formula:

$$\theta(°C.) = 180 - 60 t'_m \log \text{ (in hours)}.$$

Mechanical strength and resistance to corrosion may be further improved by carrying out prior to the principal aging operation (or the pre-aging operation), a plastic deformation operation of between 0.5 and 5%, which is generally effected by planing, controlled traction or compression, drawing, rolling, etc.

After the principal aging operation, the products have:

- moderately elevated characteristics in respect of mechanical strength, which are equivalent to those of 2024 T351 and which permit either a shaping operation or a hardening operation by working without the risk of rupture, or intermediate straightening, planing, etc. operations, corresponding to a degree of plastic deformation of between 0.5 and 5%;
- elevated degrees of elongation in respect of traction;
- a particularly elevated striction value, in particular when the principal aging operation is preceded by a working operation after quenching on an alloy containing the phase S or S';
- a good degree of homogeneity in the mechanical properties of thick products;
- a good degree of isotropy in respect of mechanical characteristics;
- a good level of resistance to surface flaking corrosion (EXCO test), intergranular corrosion (standard AIR 9048) as well as improved resistance to stress corrosion, in comparison with the annealing operation T6 or under-aging;
- appreciable attenuation of undesirable flaked rupture facies; and
- better impact strength than in the under-aged state with equivalent hardness.

The level of the mechanical characteristics as well as resistance to intergranular corrosion or stress corrosion are further improved by a complementary aging operation which is carried out at a temperature (θ) lower than that of a principal aging operation and between 170° and 210° C., for a period of time tm of higher than $\theta(°C.) = 230 - 66 \log t\,m$ (hours) and less than 60 hours. The temperature is preferably between 175° and 205° C.

Excessively short periods of time and/or excessively low temperatures result in excessive levels of fragility without a substantial improvement in resistance to corrosion in the crude state after the principal aging operation and excessively long periods of time and/or excessively high temperatures result in increased fragility due to excessive precipitation of Li-rich intergranular phases and correlated increase in size of the precipitation free zones in respect of the phase δ'.

Under those conditions, the size of the spherical phase δ' is higher than or equal to 10 nm or else it is precipitated in elongate or semi-circular form at the interface between the phases $T'_1$ or $T_1$, S' or S and the Al matrix.

The complementary aging operation may be carried out either separately or with continuous cooling after the principal aging operation. In the former case, it is possible to carry out a cold working operation between the two aging operations, of between 0.5 and 5%, so as to increase the level of mechanical characteristics and resistance to corrosion.

The invention will be better appreciated by reference to the Examples described hereinafter and illustrated by the following Figures.

EXAMPLE 1

Figure 1:
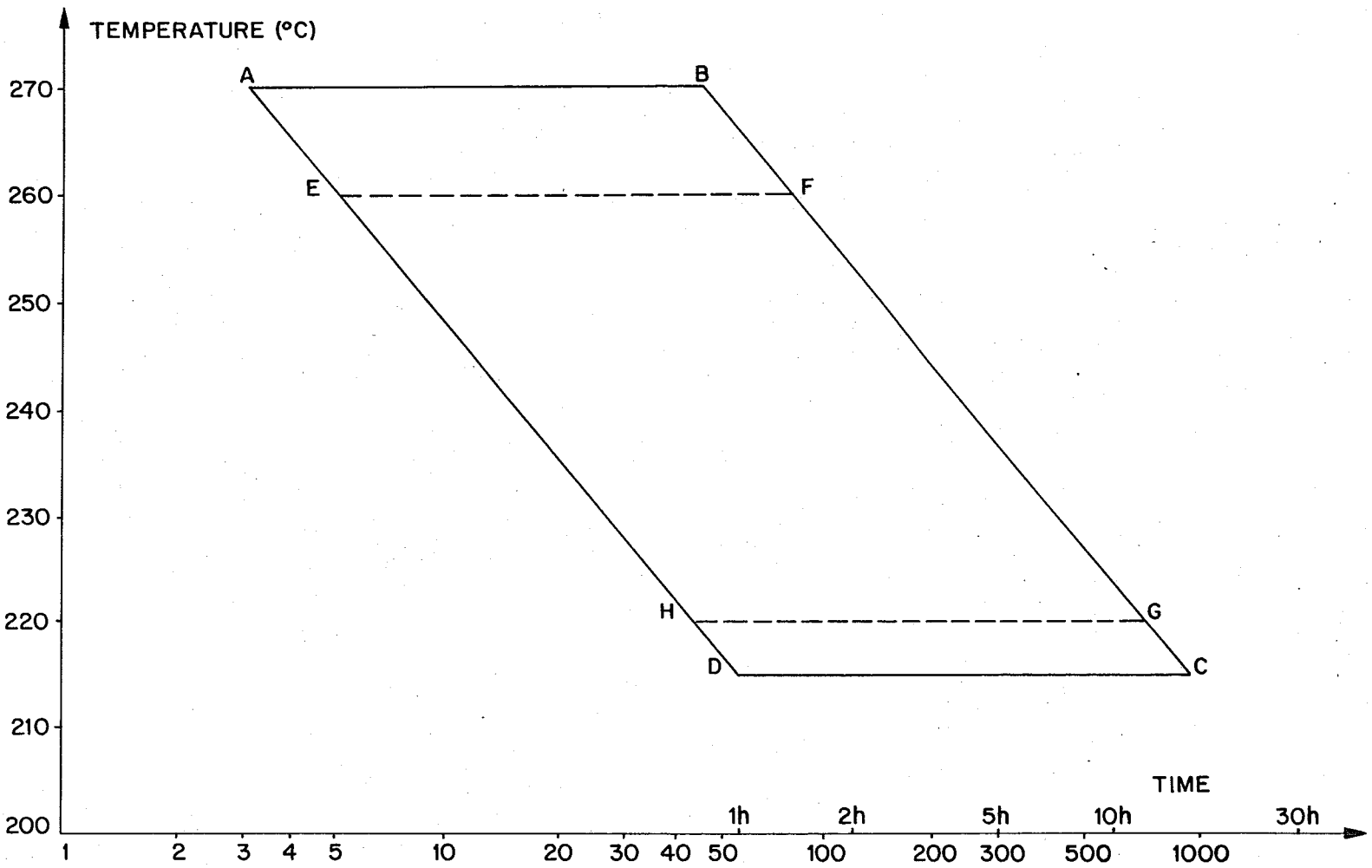
FIG. 1 represents the general range (ABCD) and the preferred range (EFGH) in respect of the temperature-time conditions of the principal aging operation in coordinates: temperature in °C.-log time in hours.
Figure 2:
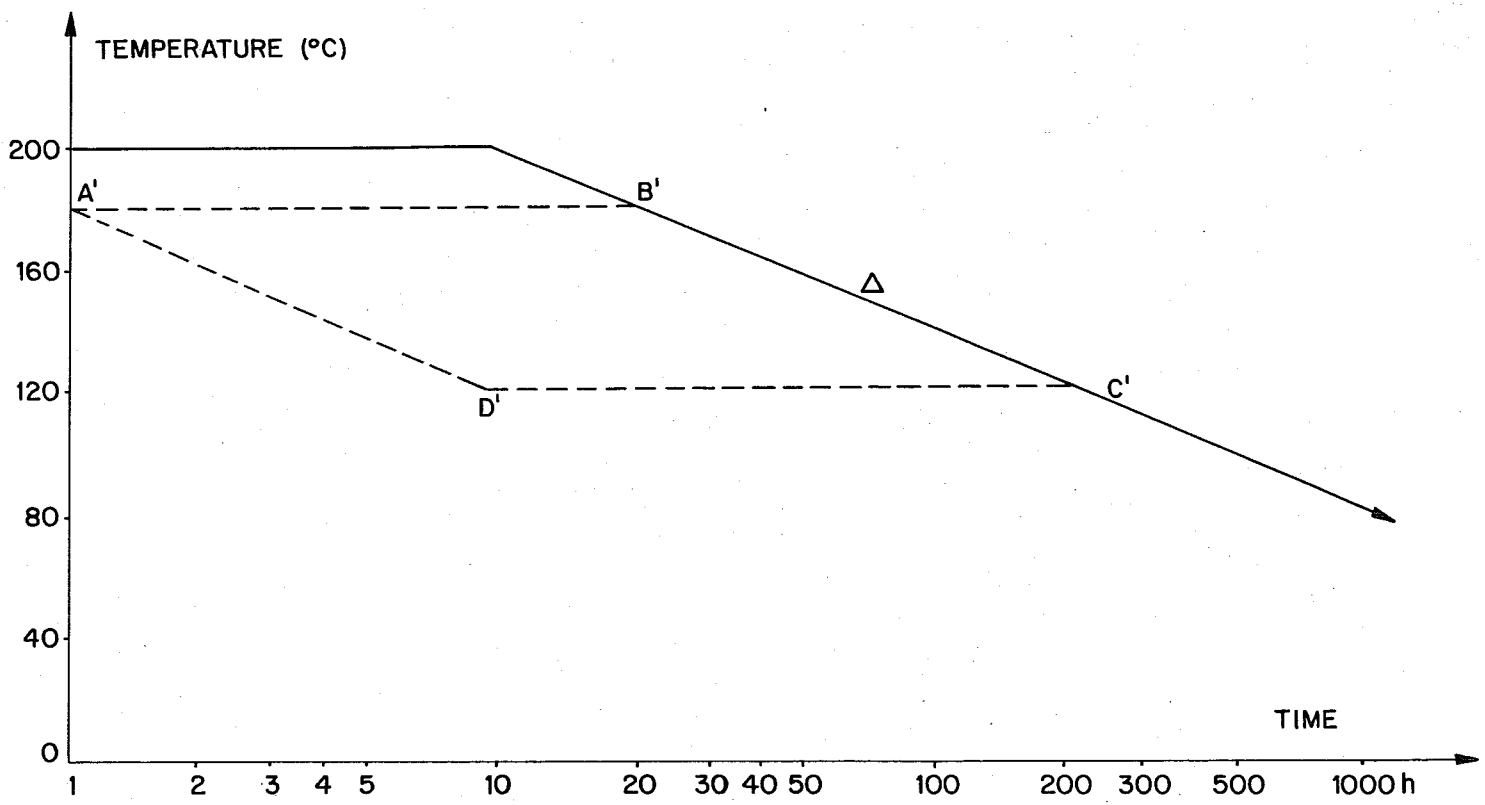
FIG. 2 represents the limit (Δ) of the pre-aging operation as well as the preferred range (A'B'C'D') thereof in coordinates: temperature in °C.-log time in hours.
Figure 3:
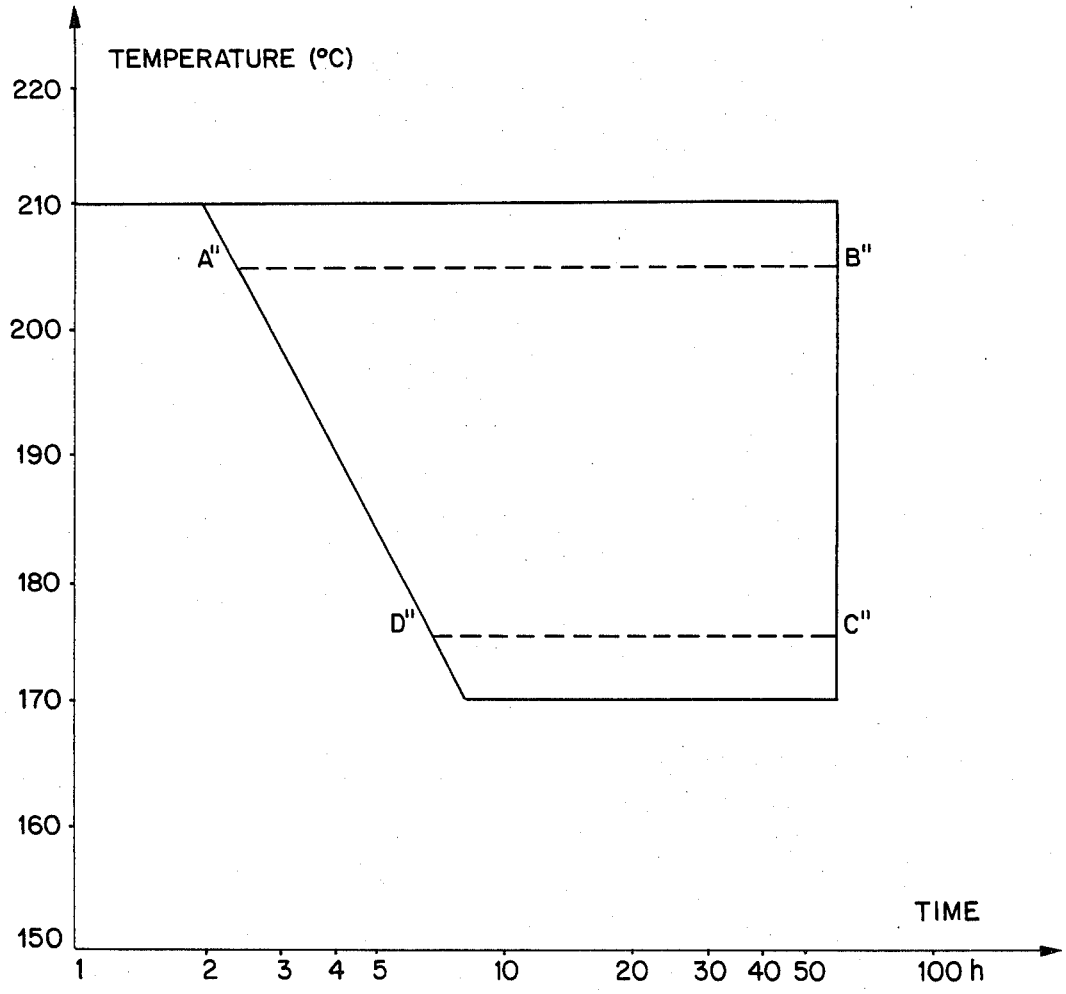
FIG. 3 represents the general range and the preferred range (A''B''C''D'') of the conditions of the complementary aging operation in coordinates: temperature °C.-log time in hours.

Flat bar members measuring 100×13 mm in section, of alloy 2091 (Li=2.0%, Cu=2.0%, Mg=1.4%, Zr=0.11%, Fe+Si=0.06%), after solution treatment (2 hours, 530° C.), quenching and controlled traction of 2% (if appropriate), were subjected either to conventional aging operations (under-aging or aging in state T6 or T651), or principal aging treatments at 240° C. in accordance with the invention. Certain treatments were preceded by a pre-aging treatment in a ventilated-air furnace. All the principal aging operations were carried out in a nitrite-nitrate salt bath furnace and were followed by cooling with water.

The flat bar members were of a non-recrystallised structure.

Table 1 gives the mechanical characteristics in respect of traction (average of 2 testpieces taken out at the half-width of the flat bar member in the longitudinal direction or over the entire width in the transverse direction=yield strength at 0.2% of residual deformation (Rp 0.2), tensile strength (Rm), elongation to rupture (A%) and striction (Σ%) measured on testpieces. The Table also shows sensitivity to intergranular corrosion as measured at the core and at the crude surface of the bar after a test in accordance with the standard AIR 9048 (continuous immersion in an aqueous solution of $NaCl+H_2O_2$).

The results show that the principal aging operation according to the invention, whether preceded by a pre-aging operation or not, results on alloy 2091 in a level of mechanical strength and ductility which is higher, in the transverse direction, than that of conventional under-aging operations and close to that of the conventional aging operation at the hardening peak (T6, T651). Moreover it results in a very marked improvement in the level of resistance to intergranular corrosion at the core and at the surface of the products, as well as excellent isotropy in respect of mechanical properties, which are achieved at the expense of a slight reduction in mechanical strength in the long direction.

Moreover the bars when treated according to the invention, in the crude condition after the principal aging operation, had a very high level of striction, in particular in the case of controlled traction after quenching, indicating the excellent ductility of the product. It is very much higher than that of all the under-aged states or of the states T6 or T651. In addition the bars which are identified in the crude state after the principal aging operation showed virtually complete absence of longitudinal secondary cracking on rupture testpieces (that is to say no substantial tendency to flaking rupture).

The diameter of the phases $\delta'$-$Al_3Li$ in the matrix, as measured with a high degree of magnification on a transmission electron microscope, was smaller than 4 nm for all the particles except for some composite particles of phase $\delta'$-$Al_3Li$ surrounding spherical particles of phase $Al_3Zr$ (diameter 40 nm approximately).

EXAMPLE 2

Thick rolled sheets measured 38.5 mm of alloy 2091 were subjected to a solution treatment for 2 hours 30 minutes at 530° C. followed by controlled traction to 2% of residual deformation and conventional aging operations (under-aging operation or over-aging operations), and principal aging treatments in accordance with the invention, all being carried out in a ventilated-air furnace with air cooling, so as to give mean levels of mechanical strength which are comparable with each other.

Table 2 shows the mechanical characteristics in respect of traction (Rp 0.2, Rm, A%), as measured respectively at half-thickness in the long direction, the transverse long direction, at 60° to the long direction (a usually weak direction in that type of product) and in the transverse short direction. The Table also shows the characteristics in respect of intergranular corrosion after continuous immersion in a 3% solution of NaCl $H_2O_2$, in accordance with aeronautical standard AIR 9048.

A good level of isotropy of the mechanical properties obtained by the treatment according to the invention is noted, which results in a level of mechanical strength equivalent to that of the state involving under-aging for 12 hours at 135° C. (comparable to that of conventional alloy 2024-T351) in the long direction and higher than that of the very slightly under-aged state (24 hours at 170° C.) in the transverse direction. The Table also shows a good level of yield strength and elongation to rupture in the transverse short direction. That is higher in particular than the value achieved by prolonged treatments at elevated temperature (outside the invention) after annealing for 3 hours at 230° C. The phase $\delta'Al_3Li$ was present in intragranular form with a diameter of less than 5 nm. Resistance to intergranular corrosion was moreover very greatly improved in comparison with that of the under-aged states, resulting in the same average level of mechanical characteristics.

EXAMPLE 3

Thin sheets with recrystallised and isotropic structure of alloy 2091, of the composition comprising Li2.0%, Cu2.0%, Mg1.4%, Zr0.08%, Fe+Si0.05%, were subjected to solution treatment for 20 minutes at 530° C. followed by quenching using cold water, a smoothing operation, controlled traction of 2% and conventional annealing operations (single-stage under-aging operations) or special aging operations according to the invention.

The principal aging operation according to the invention which was carried out in a ventilated-air furnace was preceded in certain cases by a pre-aging operation carried out in a ventilated-air furnace. Cooling was effected with still air after the principal aging operation.

The sheets were characterised in respect of hardness or by traction tests in the long and transverse-long directions, as well as by an intergranular corrosion test in accordance with AIR 9048 and a flaking corrosion test (EXCO test) at the core and the surface and a test in respect of stress corrosion by traction in the transverse-long direction by alternate immersion-emersion using a 3.5% NaCl solution over the entire thickness of the testpieces. Measurements were also taken in respect of impact strength (energy absorbed) by a ball test as used in the aeronautical industry to evaluate fragility in respect of impact of structural or fuselage components, by identifying the energy necessary to create a crack in the component associated with the deformation caused by the steel ball which is projected onto the plate or sheet from increasing heights.

It is found that the plates or sheets treated by a principal aging operation in accordance with the invention, with identical yield strength or hardness, have an improved impact strength as ascertained by means of the ball test, in comparison with the under-aged states which are reputed to tolerate the damage involved, as well as a better level of resistance to intergranular corrosion and stress corrosion (non-rupture stress NR30 at 30 days of testing, carried out in the transverse-long direction).

Moreover their resistance to flaking corrosion is excellent at the surface of the plates or sheets where it is better than that of the under-aged plates or sheets, and acceptable at the core (Table 3). All the sheets according to the invention showed dense co-precipitation of phase S' $Al_2CuMg$ and phase $\delta'Al_3Li$, the latter being smaller in diameter than 5 nm, in contrast to the conventional states (under-aged T651, over-aged).

Table 3 bis shows that the aging operation according to the invention results, with equivalent hardness, in a better level of resistance to intergranular corrosion than under-aging operations, with elevated levels of impact strength (which shows the absence of fragility).

EXAMPLE 4

Extruded bars of rectangular section (60×30 mm) and of a composition consisting of Li2.1%-Cu2.6%-Mg0.4%-Zr0.09%-Fe+Si0.07, after solution treatment and quenching with cold water, were subjected to aging treatments of different durations at different temperatures in laboratory conditions. Their resistance to stress corrosion was measured in the transverse-short direction on rings C in accordance with the test involving alternate immersion and emersion using a 3.5% NaCl solution, in accordance with standard AIR 9048.

Surprisingly, it was found that aging treatments in accordance with the invention at 230° C. in an air-type furnace (air cooling) result in dense precipitation of phase $T'_1$ or $T_1$-$Al_2CuLi$ and substantial dissolution of the phase δ'-$Al_3Li$ (highly dispersed large particles of phase δ' of a size larger than 30 mm and high density of very fine particles of phase δ': diameter smaller than 6 nm) resulting in satisfactory levels of resistance to stress corrosion, in contrast to the conventional under-aged or even over-aged states.

EXAMPLE 5

Extruded flat bar members of a configuration measuring 100×13 mm and of non-recrystallised structure (composition Li1.8%, Cu2.04%, Mg1.52%, Zr0.10%, Fe+Si0.05%, controlled by atomic absorption) after solution treatment for 2 hours at 528° C., were subjected to aging treatments which were conventional or in accordance with the invention, and a principal aging treatment according to the invention (in a salt bath furnace), followed by cooling with water and controlled traction to 2.5% of residual deformation. The structure after the treatment according to the invention was characterised by the total absence of coarse phase δ'-$Al_3Li$ (except around particles of phase $Al_3Zr$) and by extremely fine precipitation of phase δ' (size smaller than 4 nm), coexisting with the precipitation of phase S' $Al_2CuMg$, for the principal aging times described in the invention, and $T_2$-$Al_6CuLi_3$.

Table 5 gives the average longitudinal mechanical traction characteristics obtained on testpieces taken at half-thickness and at the edge of the flat bar member.

A substantial improvement in elongation to rupture is noted, as well as a very slight tendency to flaked intergranular rupture, on traction testpieces when treated in accordance with the invention.

EXAMPLE 6

Extruded flat bar members of alloy 2091, of a section measuring 100×13 mm, of composition A and B and of identical origin to those of the members described in Examples 1 and 5 were subjected, after quenching, optionally cold working, principal aging and cooling to ambient temperature, to a complementary-aging operation as described in the present invention.

Table 6 shows the improvements in the mechanical strength which are achieved in that way and which permit the alloys when treated according to the invention to have, after a complementary aging operation at 170° C. or 190° C., a level of mechanical characteristics comparable to that of state T6 or T651, as well as improved resistance to intergranular corrosion, without a substantial fall in ductility and striction values. The size of the phase δ'-$Al_3Li$ after complementary annealing is of the order of 20 nm.

EXAMPLE 7

Thin sheets (thickness 1.6 mm) of alloy 2091 in the initial state T351 identical to those of Example 3 were subjected to conventional simple aging treatments as well as principal aging treatments followed by a complementary aging operation in accordance with the invention. The latter were carried out with return to ambient temperature (air cooling after principal aging or continuously by controlled cooling within the furnace (at a rate of temperature fall of the order of 10° to 40° C. per hour), by the admission of fresh air.

Table 7 gives the values in respect of hardness, impact strength (energy absorbed by the ball test) and resistance to intergranular corrosion. They are generally improved in comparison with the treatment involving slight under-aging for 12 hours at 170° C.

EXAMPLE 8

Thick rolled sheets measuring 38.5 mm of alloy 2091 of the same origin and composition as those used in Example 2, after quenching and controlled traction to 2%, were subjected to conventional single-stage aging operations and a principal aging treatment for 3 hours at 230° C. followed, after continuous cooling at a rate of 20° C./hour between 230° and 190° C., by a complementary aging operation for 12 hours at 190° C. which is carried out in the same furnace with final cooling at a rate of 20° C./hour from 190° C. to 170° C. and discharge into still air, until ambient temperature is reached.

Table 8 gives the results of the characterisation operations which were carried out, being identical to those set forth in Table 2 (see Example 2).

It is found that the aging operation according to the invention markedly improves the properties in respect to elastic limit and tensile strength in the transverse direction, as well as the isotropy in respect to mechanical properties, while retaining an attractive level in the longitudinal direction and improving resistance to intergranular corrosion.

The structure observed after continuous two-stage treatment according to the invention is characterised by coarse re-precipitation of spherical δ'-$Al_3Li$ (size larger than 20 nm) and also in elongate form along numerous needles of phase S'-$Al_2CuMg$ in the matrix (at the interface).

TABLE 1

| Controlled traction after quenching | Aging state | Mechanical traction characteristics | | | | | | | | Sensitivity to intergranular corrosion Test NaCl + $H_2O_2$ | |
|---|---|---|---|---|---|---|---|---|---|---|---|
| | | Long direction | | | | Transverse long direction | | | | | |
| | | Rp 0.2 (MPa) | Rm (MPa) | A (%) | (%) | Rp 0.2 (MPa) | Rm (MPa) | A (%) | (%) | Surface | Half-thickness |
| — | without (T4) | 412 | 500 | 11.2 | 10.7 | 303 | 427 | 17.5 | 24.5 | nil | low |
| — | 12 h 150° C. (under-aging) | 460 | 520 | 8.7 | 9.0 | 338 | 452 | 9.7 | 23.7 | moderate | high |
| — | 12 h 170° C. (under-aging) | 466 | 530 | 10 | 10.7 | 344 | 456 | 13.7 | 25.2 | high | high |
| — | 45 min 240° C. (according to the invention) | 415 | 504 | 11.2 | 17.9 | 346 | 432 | 11.2 | 30.2 | very low | low |

TABLE 1-continued

| Controlled traction after quenching | Aging state | Mechanical traction characteristics: Long direction Rp 0.2 (MPa) | Rm (MPa) | A (%) | (%) | Transverse long direction Rp 0.2 (MPa) | Rm (MPa) | A (%) | (%) | Sensitivity to intergranular corrosion Test NaCl + $H_2O_2$: Surface | Half-thickness |
|---|---|---|---|---|---|---|---|---|---|---|---|
| — | 12 h 150° C. + 45 min. 240° C. (according to the invention) | 410 | 502 | 12.5 | 17.9 | 345 | 433 | 12.5 | 33.0 | very low | very low |
| — | 12 h 170° C. + 45 min. 240° C. (according to the invention) | 404 | 496 | 12.5 | 22.6 | 344 | 422 | 11.2 | 33.0 | low | low |
| 2% | without (T 351) | 392 | 470 | 15 | 12.9 | 288 | 404 | 16.2 | 28.2 | nil | very low |
| " | 12 h 150° C. (under-aging) | 486 | 536 | 7.5 | 14.5 | 354 | 462 | 11.2 | 28.9 | very low | very high |
| " | 12 h 170° C. (under-aging) | 500 | 554 | 10 | 7.7 | 357 | 471 | 10 | 23.3 | moderate | high |
| " | 45 min. 240° C. (acc. to inv.) | 422 | 484 | 12.5 | 39.6 | 381 | 430 | 10.0 | 41.3 | nil | very low |
| " | 12 h 150° C. + 45 min. 240° C. (acc. to inv.) | 418 | 480 | 12.5 | 41.0 | 384 | 428 | 11.2 | 39.0 | nil | very low |
| " | 12 h 170° C. + 45 min. 240° C. (acc. to inv.) | 426 | 486 | 12.5 | 41.0 | 382 | 425 | 11.2 | 43.8 | nil | very low |

TABLE 2

| Treat-ment | Aging state | Mechanical traction characteristics (MPa): Long direction Rp 0.2 | Rm | A/% | T.L. direction Rp 0.2 | Rm | A/% | 60°/L direction Rp 0.2 | Rm | A/% | T.S. direction Rp 0.2 | Rm | A/% | Intergranular corrosion test: Classi-fication | Sensitivity to intergranular corrosion |
|---|---|---|---|---|---|---|---|---|---|---|---|---|---|---|---|
| A | 12 h 135° C. (under-aging) | 394 | 472 | 12.5 | 331 | 443 | 14.9 | 295 | 415 | 18.2 | 286 | 421 | 7.0 | I | High |
| B | 24 h 170° C. (slight under-aging) | 443 | 518 | 10.6 | 383 | 484 | 8.7 | 340 | 452 | 13.1 | 335 | 458 | 5.6 | I | High |
| C | 3 h 230° C. (according to the invention) | 399 | 455 | 8.5 | 391 | 466 | 7.9 | 360 | 416 | 9.1 | 355 | 425 | 5.0 | P + I | Low |
| D | 24 h 215° C. (over-aging) | 406 | 464 | 7.5 | 399 | 449 | 6.4 | 374 | 431 | 7.2 | 375 | 417 | 1.7 | P + I | Very low |
| E | 12 h 235° C. (outside the invention) | 377 | 443 | 7.2 | 372 | 430 | 6.7 | 353 | 415 | 8.0 | 353 | 409 | 3.3 | P + I | Very low |

TABLE 3

Thin sheets of alloy 2091 — $\tau$ = 1.6 mm

| AGING TREATMENT (initial state T351) | MECHANICAL TRACTION CHARACTERISTICS: Long direction Rp 0.2 (MPa) | Rm (MPa) | A (%) | Transverse long direction Rp 0.2 (MPa) | Rm (MPa) | A (%) | IMPACT ENERGY (*) W (J) |
|---|---|---|---|---|---|---|---|
| 12 h 150° C. (under-aged) | 332 | 438 | 17 | 329 | 455 | 13 | 10.5 |
| 12 h 170° C. (under-aged) | 347 | 448 | 16 | 348 | 466 | 14 | 7.3 |
| 1 h 30 230° C. (acc. to inv.) | 375 | 423 | 9 | 378 | 432 | 9 | ≧18.2 |
| 12 h 150° C. + 1 h 30 230° C. (acc. to inv.) | 375 | 421 | 10 | 384 | 434 | 10 | 12.3 |
| 12 h 170° C. + 1 h 30 230° C. (acc. to inv.) | 386 | 426 | 11 | 388 | 433 | 11 | 7.7 |
| 45 min. 240° C. (acc. to inv.) | 368 | 415 | 9 | 373 | 420 | 10 | 10.9 |
| 12 h 150° C. + 45 min 240° C. (acc. to inv.) | 376 | 421 | 9 | 370 | 428 | 10 | 14.1 |
| 12 h 170° C. + 45 min 240° C. (acc. to inv.) | 359 | 409 | 11 | 368 | 418 | 9 | ≧18.2 |

| AGING TREATMENT (initial state T351) | CORROSION TESTS: FLAKING EXCO CLASSIFICATION (**) Surface | Core | C. INTERGRANULAR (***) (sensitivity) Surface | Core | CORROSION UNDER STRESS-TL DIRECTION (****) σNR 30 (MPa) |
|---|---|---|---|---|---|
| 12 h 150° C. (under-aged) | EA | EA | VH | VH | ≦100 |
| 12 h 170° C. (under-aged) | EB | EB | H | H | ≦100 |
| 1 h 30 230° C. (acc. to inv.) | Fp | EA/EB | vl | A | <200 [ >150 |
| 12 h 150° C. + 1 h 30 230° C. (acc. to inv.) | Fp | EA/EB | P | A | <280 [ >200 |
| 12 h 170° C. + 1 h 30 230° C. (acc. to inv.) | Fp | EA/EB | l | A | ~200 <280 |

TABLE 3-continued

| Thin sheets of alloy 2091 – τ = 1.6 mm | | | | | |
|---|---|---|---|---|---|
| 45 min. 240° C. (acc. to inv.) | N | EA | vl | A | >200 |
| 12 h 150° C. + 45 min 240° C. (acc. to inv.) | N | EA | vl | A | ~200 |
| 12 h 170° C. + 45 min 240° C. (acc. to inv.) | Fp | EA/EB | l | A | <280<br>>200 |

*Ball test
**Flaking corrosion: N = nil Fp = Flaking pits EA = low EB = moderate EC = high ED = very high
***Sensitivity to intergranular corrosion P = nil (pits) vl = very low l = low A = average H = high VH = very high
****σNR 30: non-rupture stress (MPa) in 30 days of a test involving alternate immersion-emersion in 3.5% NaCl solution TABLE 3 bis

| Thin sheets of alloy 2091 – τ = 1.6 mm | | | | |
|---|---|---|---|---|
| AGING (initial state T 351) | VICKERS HARDNESS Hv (kg/mm²) | IMPACT ENERGY W (J) | SENSITIVITY TO INTERGRANULAR CORROSION Surface | Core |
| 12 h 150° C. (under-aging) | 135 | 10.5 | VH | VH |
| 12 h 170° C. (under-aging 1) | 140 | 7.3 | H | H |
| 12 h 190° C. (T 651) | 153 | 4.1 | l | H |
| 1 h 30 230° C. (according to the invention) | 134 | 9.1 | vl | A |
| 3 h 230° C. (according to the invention) | 134 | 8.6 | vl | A-l |
| 4 h 30 230° C. (according to the invention) | 135 | 7.3 | vl | A-l |
| 6 h 230° C. (according to the invention) | 133 | 7.3 | P | A-l |
| 45 min. 240° C. (according to the invention) | 135 | 10.9 | vl | A |
| 1 h 30 240° C. (according to the invention) | 133 | 8.4 | vl | A-l |
| 12 h 210° C. (over-aged) | 142 | 4.5 | l | A |

TABLE 4

| AGING | LIFE (in days) |
|---|---|
| 48 h 110° C. under-aged | 8,3,3 |
| 12 h 150° C. | 5,1,2 |
| 48 h 190° C. (slightly under-aged) | 3,3,3 |
| 3 h 190° C. (under-aged) | 4,1,4 |
| 12 h 190° C. (T6) | 1,1,1 |

TABLE 4-continued

| AGING | LIFE (in days) |
|---|---|
| 48 h 190° C. (over-aged) | 5,6,NR30 |
| 3 h 230° C. (according to the invention) | 3NR30* |
| 24 h 150° C. + 3 h 230° C. (according to the invention) | 3NR30* |

*3NR30: 3 testpieces unbroken in 30 days of testing

TABLE 5

| STATE | BAR EDGE Rp 0.2 (MPa) | Rm (MPa) | A % | BAR CENTRE Rp 0.2 (MPa) | Rm (MPa) | A % | SIZE OF δ' |
|---|---|---|---|---|---|---|---|
| T4 (aged) | 364 | 454 | 8 | 313 | 421 | 12 | Fine (≧5 nm) |
| 10 min. at 250° C. | 380 | 470 | 12 | 306 | 409 | 14 | Very fine <4 nm +S' $Al_2Cu$ Mg |
| 60 min. at 230° C. | 414 | 515 | 12 | 364 | 465 | 14 | Very fine <4 nm +S' $Al_2CuMg$ dense |
| 60 min. at 230° C. + Traction 2.5% | 482 | 518 | 9.5 | 442 | 482 | 9.6 | $d^0$ |
| 2024-T4 | | | | 320 | 500 | 15 | Conventional |
| 2024-T341 Traction 2% | | | | 400 | 530 | 13 | references |

TABLE 6

| Controlled traction after quenching and alloy | | Aged state | Mechanical traction characteristics (MPa) Long direction* Rp 0.2 | Rm | A % | Transverse long direction Rp 0.2 | Rm | A % | Sensitivity to corrosion Surface | Half-thickness |
|---|---|---|---|---|---|---|---|---|---|---|
| 0% | A | 24 h 190° C. (T6) | 533 | 608 | 10 | 430 | 515 | 7.5 | Low | Average |
| " | A | 45 min. 240° C. + 12 h 170° C. (according to the invention) | 540 | 594 | 7.5 | 444 | 510 | 6.2 | Very low | Low |
| 2% | A | 24 h 190° C. (T651) | 544 | 576 | 8.7 | 471 | 511 | 7.5 | Very low | Low |
| " | A | 45 min. 240° C. + 12 h 170° C. | 548 | 572 | 7.5 | 464 | 512 | 5 | Nil | Very low |

TABLE 6-continued

| Controlled traction after quenching and alloy | | Aged state | Mechanical traction characteristics (MPa) Long direction* Rp 0.2 | Rm | A % | Transverse long direction Rp 0.2 | Rm | A % | Sensitivity to corrosion Surface | Half-thickness |
|---|---|---|---|---|---|---|---|---|---|---|
| 0% | B | 24 h 190° C. (T6) | 456 | 523 | 10 | | | | | |
| " | B | 1 h 230° C. + 24 h 190° C. | 476 | 549 | 11 | | | | | |

Alloy 2091: (A) = Li = 2.0%, Cu = 2.0%, Mg = 1.4%, Zr = 0.11%, Fe + Si = 0.06%,
(B) = Li = 1.82%, Cu = 2.04%, Mg = 1.52%, Zr = 0.10%, Fe + Si = 0.07%
*Composition (A) average centre + edge of flat member
(B) values centre of flat member

TABLE 7

| ANNEALING | VICKERS HARDNESS HV (Kg/mm$^2$) | IMPACT ENERGY W (J) | SENSITIVITY TO INTERGRANULAR CORROSION Surface | Core |
|---|---|---|---|---|
| 3 h 230° C. + 12 h 190° C. (intermed. air cooling) | 144 | 4.1 | very low | low |
| 3 h 230° C. + 12 h 190° C. (controlled cooling) | 142 | 5.5 | very low | low |
| 3 h 230° C. + 3 h 190° C. (controlled cooling) | 140 | 6.8 | very low | moderately low |
| 3 h 230° C. + 3 h 210° C. (controlled cooling) | 138 | 6.4 | very low | moderately low |
| 3 h 230° C. + 12 h 170° C. (controlled cooling) | 144 | 5 | low | moderately low |
| 3 h 230° C. + 12 h 210° C. (intermed. air cooling) | 137 | 5.5 | nil | low |
| 3 h 230° C. + 48 h 210° C. (intermed. air cooling) | 133 | 5.5 | nil | nil |
| 12 h 170° C. (under-aging) | 140 | 7.3 | high | high |

TABLE 8

| AGING STATE | MECHANICAL TRACTION CHARACTERISTICS (MPa) Long direction Rp 0.2 | Rm | A % | T-L direction Rp 0.2 | Rm | A % | 60°/L direction Rp 0.2 | Rm | A % | T-S direction Rp 0.2 | Rm | A % | SENSITIVITY TO INTERGRANULAR CORROSION (CORE) |
|---|---|---|---|---|---|---|---|---|---|---|---|---|---|
| 12 h 190° (T651) | 473 | 523 | 8.3 | 430 | 495 | 7.8 | 386 | 464 | 9.8 | 383 | 466 | 3.4 | Average to low |
| 48 h 170° (T651) | 471 | 534 | 8.8 | 419 | 501 | 7.0 | 374 | 469 | 9.6 | 362 | 466 | 3.4 | Average to low |
| 3 h 230° + 12 h 190° (acc. to invent.) | 425 | 485 | 7.1 | 414 | 466 | 6.5 | 392 | 451 | 7.1 | 390 | 457 | 3.5 | Very low |
| 24 h 215° (over-aged) | 406 | 464 | 7.5 | 399 | 449 | 6.4 | 374 | 431 | 7.2 | 375 | 417 | 1.7 | Very low |

I claim:

1. In a method of heat treatment of Al alloys containing Li and at least one principal element selected from the group consisting of Cu, Mg and Zn as well as optional minor elements comprising Zr, Mn, Ni, Hf, Ti and Be and optional impurities comprising Fe and Si, the balance being Al, said method comprising a solution treatment and a quenching operation, an optional plastic deformation and natural ageing operation followed by a least one ageing operation, the improvement wherein said at least one ageing operation includes a principal ageing operation carried out in an area defined by a parallelogram, in a temperature-log-time diagram, whose corners have the following coordinates:

A 270° C.-3 min
B 270° C.-48 min
C 215° C.-16 hr
D 215° C.-1 hr and is followed by a complementary ageing at a temperature lower than that of the principal ageing and which is between 165° and 215° C.

2. A method according to claim 1, wherein the principal ageing operation is carried out in a range of temperatures which is defined on a temperature-log time diagram by a parallelogram whose corners have the following coordinates:

E 260° C.-5 min
F 260° C.-1 hr 20 min
G 220° C.-12 hr
H 220° C.-45 min.

3. A method according to claim 1 or 2, wherein the duration, in hours, of the complementary ageing operation is greater than a period $t''_m$ corresponding to the formula $\theta(°C.)=230-60 \log t''_m$ and less than 60 hours.

4. A method according to claim 1 or 2, wherein the temperature of the complementary ageing operation is between 170° C. and 210° C.

5. A method according to claim 3, wherein the temperature of the complementary ageing operation is between 170° C. and 210° C.

6. A method according to claim 1 or 2, wherein the principal and complementary ageing operations are effected separately.

7. A method according to claim 3, wherein the principal and complementary ageing operations are effected separately.

8. A method according to claim 4, wherein the principal and complementary ageing operations are effected separately.

9. A method according to claim 5, wherein the principal and complementary ageing operations are separated by a continuous cooling step.

10. A method according to claim 1 or 2, wherein the principal and complementary ageing operations are separated by a continuous cooling step.

11. A method according to claim 3, wherein the principal and complementary ageing operations are separated by a continuous cooling step.

12. A method according to claim 4, wherein the principal and complementary ageing operations are separated by a continuous cooling step.

13. A method according to claim 5, wherein the principal and complementary ageing operations are separated by a continuous cooling step.

14. A method according to claim 6, wherein the principal and complementary ageing operations are separated by a continuous cooling step.

15. A method according to claim 7, wherein the principal and complementary ageing operations are separated by a continuous cooling step.

16. A method according to claim 8, wherein the principal and complementary ageing operations are separated by a continuous cooling step.

17. A method according to claim 9, wherein the principal and complementary ageing operations are separated by a continuous cooling step.

18. A method according to claim 6, wherein a cold working operation of between 0.5 and 5% is effected between the principal and complementary ageing operations.

19. A method according to claim 7, wherein a cold working operation of between 0.5 and 5% is effected between the principal and complementary ageing operations.

20. A method according to claim 8, wherein a cold working operation of between 0.5 and 5% is effected between the principal and complementary ageing operations.

21. A method according to claim 9, wherein a cold working operation of between 0.5 and 5% is effected between the principal and complementary ageing operations.

22. A method according to claim 6 or 7, wherein the principal ageing operation is preceded by a pre-ageing operation which is carried out in a temperature range of lower than 200° C. and for a maximum period, in hours, $t'_M$ such that $\theta(°C.) = -60 \log t'_M + 260$.

23. A method according to claim 22, wherein the pre-ageing is carried out in a temperature field from 120° to 180° C. for a minimum time, in hours, t'm given by $\theta(°C.) = 180 - 60 \log t'm$.

24. A method according to claim 22, wherein the quenching operation is followed by plastic deformation of between 0.5 and 5%.

25. A method according to claim 23, wherein the quenching operation is followed by plastic deformation of between 0.5 and 5%.

26. Product produced by the method of claim 1 or 2, in the form of an Al matrix containing a dense precipitation of the phases $T'_1$ or $T_1$, S' or S, $T'_2$ or $T_2$, a precipitation of individual spherical phases δ' of a size greater than 10 nm, and a heterogenous precipitation of phase δ', of elongated or semi-circular form, at the interface between phases $T'_1$ or $T_1$, or S' and S and the Al matrix.

* * * * *

UNITED STATES PATENT AND TRADEMARK OFFICE

CERTIFICATE OF CORRECTION

PATENT NO. : 4,812,178

DATED : March 14, 1989

INVENTOR(S) : Bruno Dubost et al

It is certified that error appears in the above-identified patent and that said Letters Patent is hereby corrected as shown below:

Title page, item [19]: "Dubost" should read --Dubost et al--

Item [76], additional inventors should be added as shown below:

-- Max Reboul
C6 Voie Fleurie
Rochepleine
38120 Saint Egreve, France

Pierre Sainfort
31 Quai Claude Bernard
38000 Grenoble, France --

Signed and Sealed this

Thirty-first Day of October, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,812,178

DATED : March 14, 1989

INVENTOR(S) : Bruno Dubost

It is certified that error appears in the above-identified patent and that said Letters Patent are hereby corrected as shown below:

Column 3, the formula at line 34 should read:

-- $\theta(°C)=180-60 \log t'_m$ (in hours). --

Signed and Sealed this

Twenty-seventh Day of February, 1990

*Attest:*

JEFFREY M. SAMUELS

*Attesting Officer* *Acting Commissioner of Patents and Trademarks*